US006155735A

United States Patent [19]

Nakajima

[11] Patent Number: 6,155,735

[45] Date of Patent: Dec. 5, 2000

[54] LIQUID COATING DEVICE

[75] Inventor: Nobuyuki Nakajima, Takasaki, Japan

[73] Assignee: Mitsubishi Pencil Kabushiki Kaisha, Tokyo, Japan

[21] Appl. No.: 09/423,711

[22] PCT Filed: Mar. 23, 1999

[86] PCT No.: PCT/JP99/01450

§ 371 Date: Nov. 9, 1999

§ 102(e) Date: Nov. 9, 1999

[87] PCT Pub. No.: WO99/48401

PCT Pub. Date: Sep. 30, 1999

[30] Foreign Application Priority Data

Mar. 20, 1998 [JP] Japan ..... 10-072489
Mar. 18, 1999 [JP] Japan ..... 11-074176

[51] Int. Cl.[7] ..... B43K 5/06

[52] U.S. Cl. ..... 401/172; 401/174

[58] Field of Search ..... 401/68, 70, 71, 401/74, 75, 78, 79, 172, 173, 174

[56] References Cited

U.S. PATENT DOCUMENTS

| | | | |
|---|---|---|---|
| 3,468,612 | 9/1969 | Aston | 401/188 R |
| 4,624,594 | 11/1986 | Sasaki et al. | 401/176 |
| 5,320,442 | 6/1994 | Yanagisawa et al. | 401/172 |
| 5,454,660 | 10/1995 | Sakurai et al. | 401/266 |
| 5,803,640 | 9/1998 | Nakajima et al. | 401/174 |
| 5,827,002 | 10/1998 | Nakajima et al. | 401/174 |
| 5,851,079 | 9/1969 | Horstman et al. | 401/174 |

FOREIGN PATENT DOCUMENTS

| | | |
|---|---|---|
| 1060087 | 3/1954 | France . |
| 63-82480 | 5/1988 | Japan . |
| 1-115415 | 8/1989 | Japan . |
| 3-103005 | 10/1991 | Japan . |
| 2211081 | 6/1989 | United Kingdom . |
| 91/15136 | 10/1991 | WIPO . |

*Primary Examiner*—Charles R. Eloshway
*Assistant Examiner*—Peter deVore
*Attorney, Agent, or Firm*—Darby & Darby

[57] ABSTRACT

A liquid pressing mechanism (11) includes: a fixed cylinder (11) having saw-toothed cam grooves (11*e*) and a female thread (11*d*) at the front end thereof; a feed element (12) fitted to this fixed cylinder (11) so as to be rotatable, having a cam portion (12*f*) formed of a cantilever spring which engages the cam grooves (11*e*) and limiting the rotational direction to only one direction; a screw rod (13) fitted through a fitting hole (12*h*) of this feed element (12) so as to move in the longitudinal direction and so as not to be rotatable and having a male thread (13*a*) on the peripheral surface thereof which is screw fitted with the female thread (11*d*) of the fixed cylinder (11); and a piston (14) fixed to the front end of the screw rod (13) projected forward from the female thread of the fixed cylinder (11) and slidably inserted whilst maintaining its fluid-tight state with respect to the inner surface of the fixed cylinder (11).

4 Claims, 17 Drawing Sheets

FIG. 8
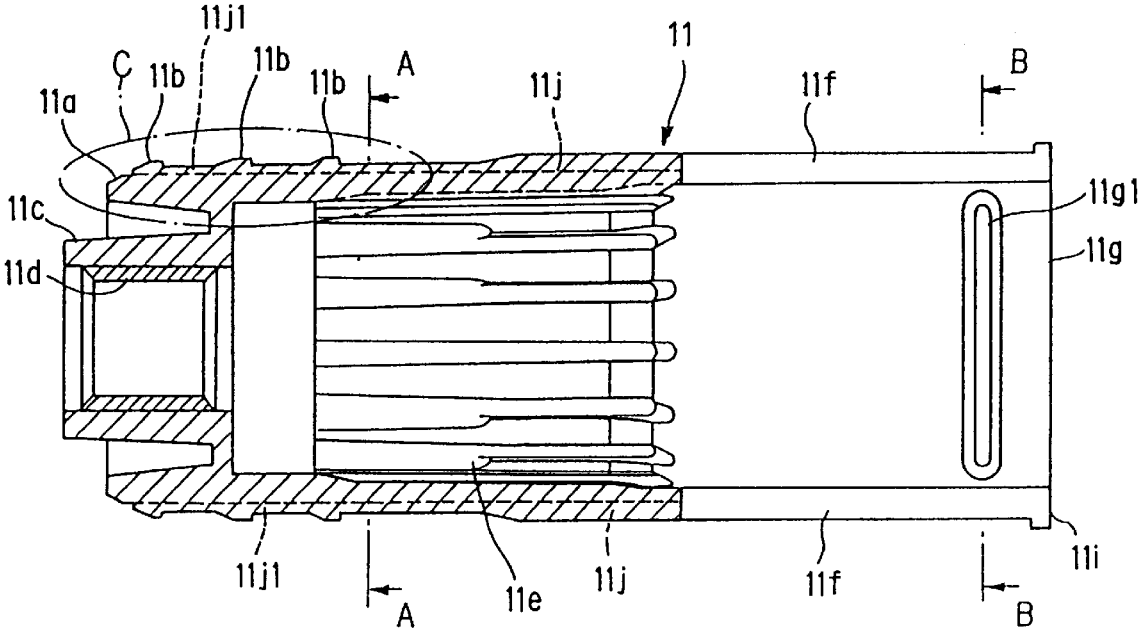
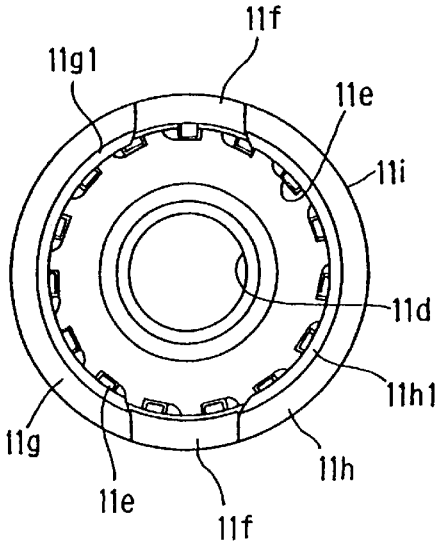
FIG. 8a

FIG. 13
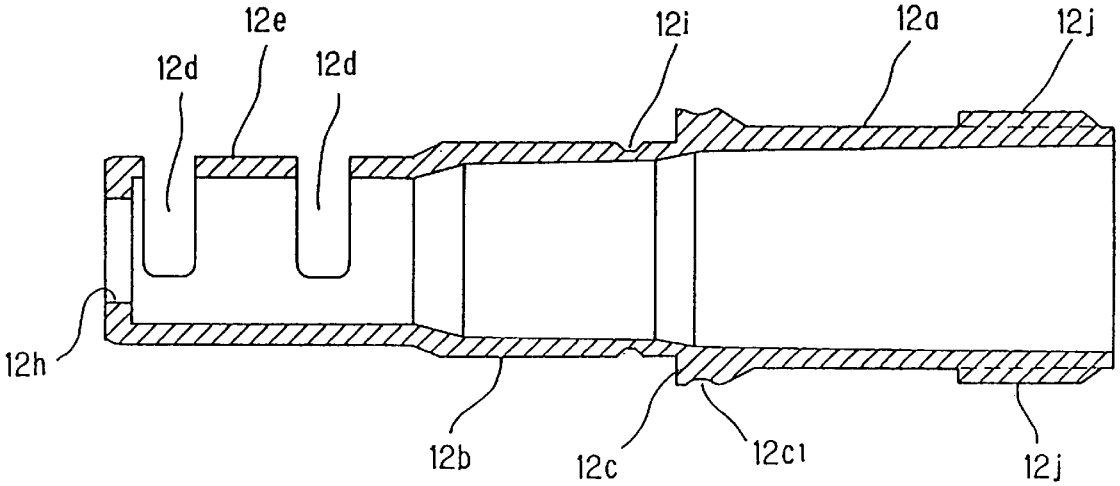
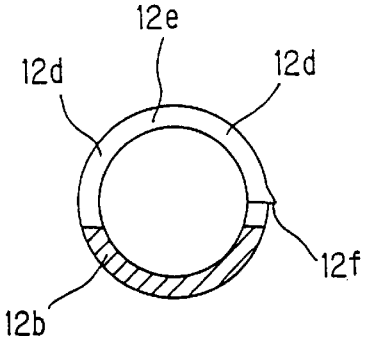
FIG. 14
FIG. 15
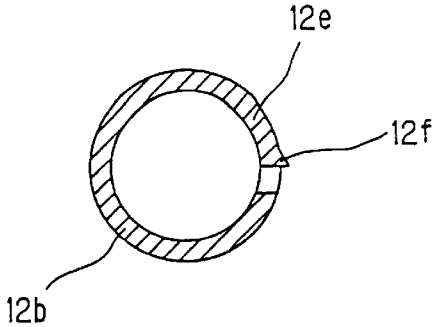

FIG. 16a
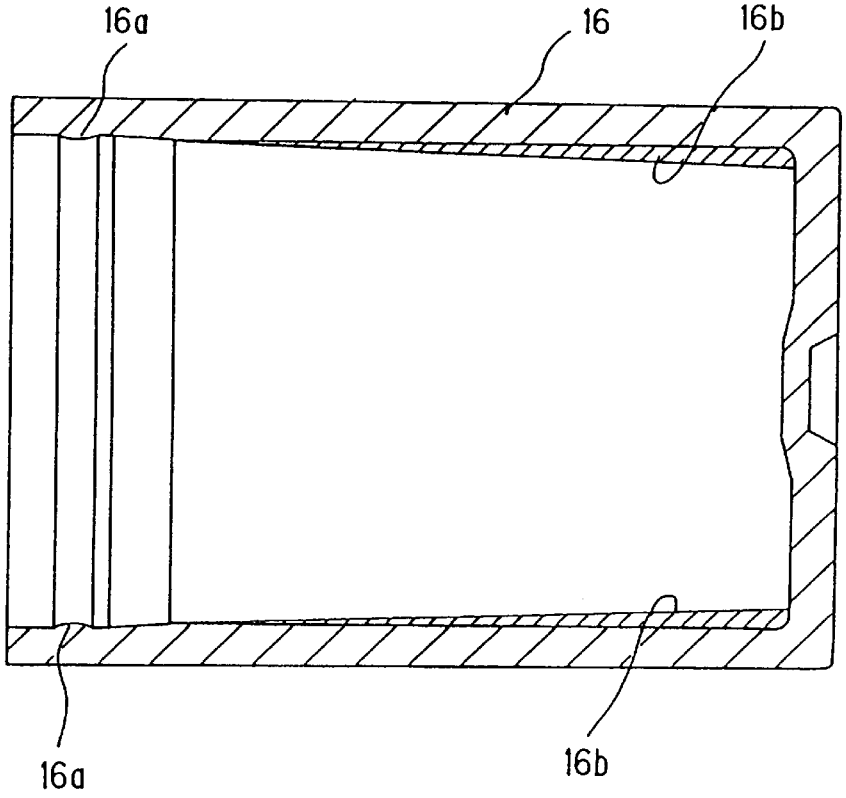
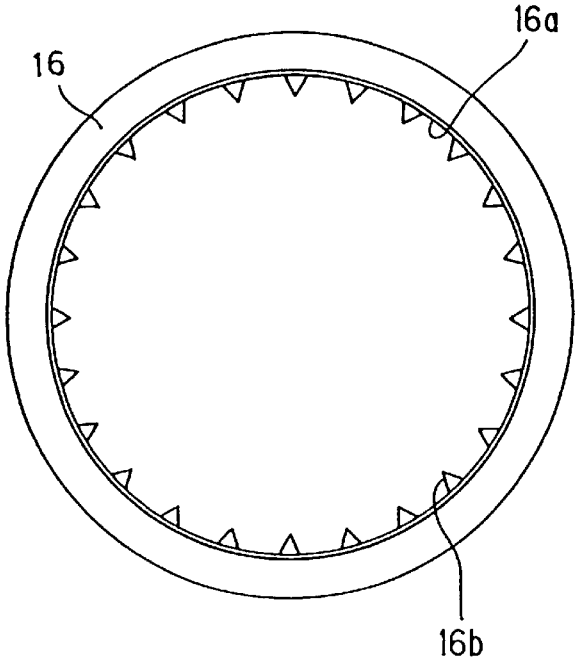
FIG. 16b

FIG. 17a
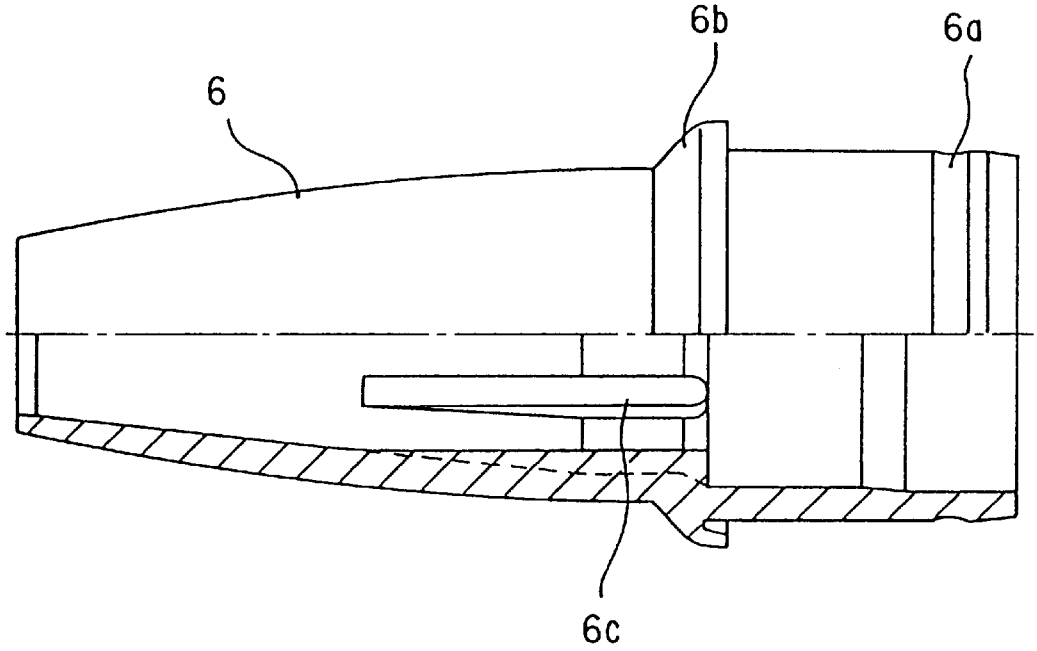
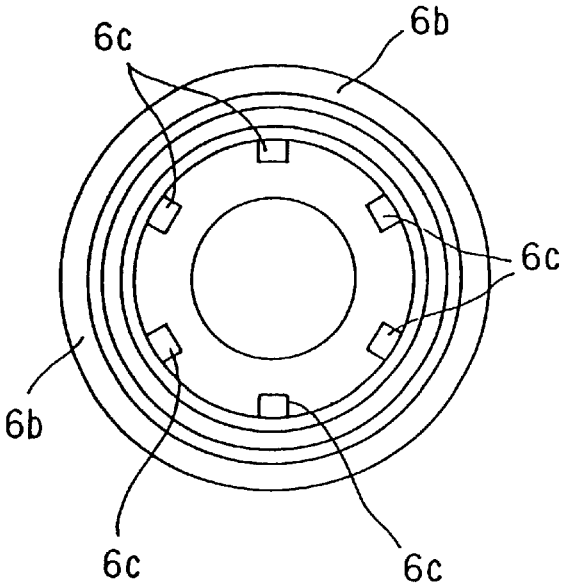
FIG. 17b

FIG. 19a
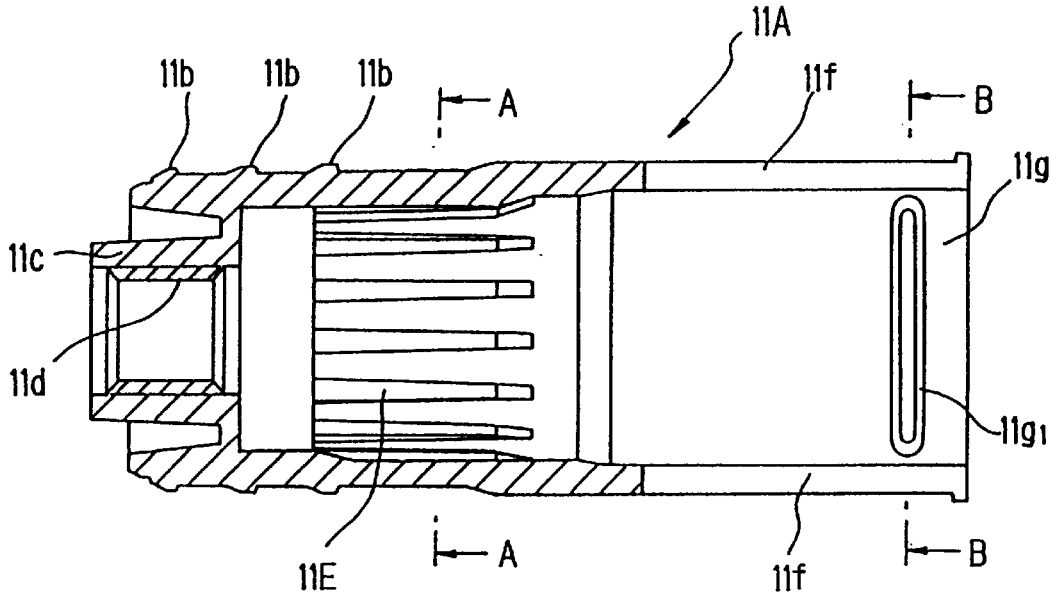
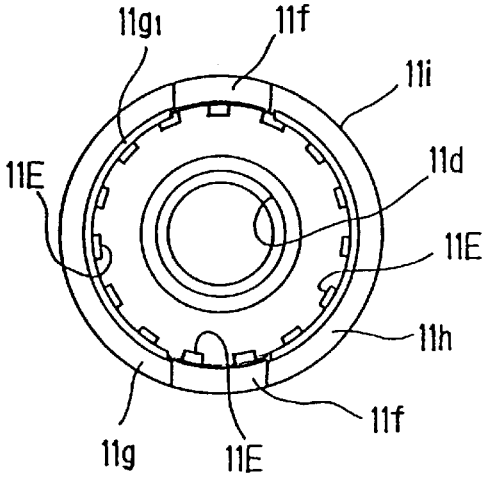
FIG. 19b
FIG. 19c
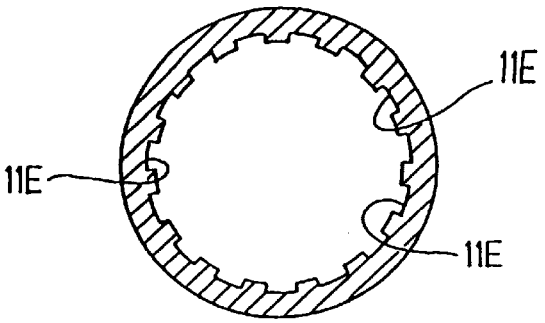

LIQUID COATING DEVICE

TECHNICAL FIELD

The present invention relates to a liquid feed applicator which incorporates a liquid paint such as liquid lip coloring etc., and can appropriately supply it to an application element.

BACKGROUND ART

Conventionally, examples of liquid applicators of this kind include those shown in FIGS. 26 and 27 and in FIG. 28.

In FIGS. 26 and 27, a main body 31 has an application element 32 at its front end and a rotary actuator 33 inserted into its rear opening. Rotary actuator 33 is configured of an outer cylindrical part 34 and an inner cylindrical part 35 inserted therein so as to be unrotatable. Outer cylindrical part 34 has a fitting projection 34*a*, which is mated with a fitting recess 31*a* in main body 31 so that outer cylindrical part 34 is able to rotate and will not fall off with respect to main body 31.

A screw rod 37 is inserted inside inner cylindrical part 35. A male thread 37*a* formed on the outer periphery of screw rod 37 is mated with a female thread 35*a* formed at the front end of inner cylindrical part 35 and fitted through an extraordinarily shaped fitting hole 31*c* in a partition wall 31*b* formed on the inner surface of main body 31. By this arrangement, screw rod 37 can move in the longitudinal direction but is not rotatable with respect to inner cylindrical part 35. Formed at the front end of outer cylindrical part 34 is a pawl 39 which resiliently engages ratchet teeth 38 formed on the inner surface of main body 31. This pawl 39 and ratchet teeth 38 constitute a ratchet mechanism 40. A piston 41 is inserted so as to move slidably with respect to the inner surface of main body 31 and is joined to the front end of screw rod 37, in front of partition wall 31*b*.

In the thus configured liquid applicator, outer cylindrical part 34 is adapted to be rotatable in only one direction with respect to main body 31, being limited by ratchet mechanism 40. As outer cylindrical part 34 is turned relative to main body 31, inner cylindrical part 35 rotates together with outer cylindrical part 34. Upon this, screw rod 37 is prohibited from rotating by fitting hole 31*c*, so that screw rod 37 and rotary actuator 33 rotate relatively from each other. Therefore, screw rod 37 moves forwards by virtue of its screw fitting with female thread 35*a* to thereby move piston 41 forwards.

As a result, an application liquid L stored in an application liquid reservoir 31A of main body 31 is pushed out by piston 41 so as to infiltrate the liquid into application element 32.

An applicator shown in FIG. 28 has an application element 52 at the front end of a cylindrical main body 51 while a piston 53 and pressing cylinder 54 are inserted into main body 51 from its rear end. Ribs 54*a* formed on the peripheral surface of pressing cylinder 54 are fitted in grooves 51*a* formed on the inner surface of main body 51 along its longitudinal direction so that they can move. Therefore, pressing cylinder 54 can move in the longitudinal direction relative to main body 51 with its rotation being prohibited. A cylindrical rotary actuator 55 is inserted at the rear end of main body 51. Rotary actuator 55 has an annular fitting projection 55*a* formed on the peripheral surface thereof, and this fits into annular fitting recess 51*b* formed on the inner surface of main body 51. This configuration permits rotary actuator 55 to slide and rotate relative to main body 51 and prevents it from being pulled out. Further, a rear portion 56*b* of a screw rod 56 having a male thread 56*a* formed thereon is inserted into rotary actuator 55 so that it cannot rotate. The part of screw rod 56 in front of rotary actuator 55 fits and engages a female thread 54*b* formed on the inner surface of pressing cylinder 54 so that it is inserted in pressing cylinder 54. Rotary actuator 55 has ratchet teeth 55*b* which engage ratchet groove 51*c* formed on the inner surface of main body 51. The engagement between ratchet teeth 55*b* and ratchet groove 51*c* constitutes a ratchet mechanism 57 for limiting the rotation of rotary actuator 55 to one direction.

In the thus configured applicator, with the rotation of rotary actuator 55, screw rod 56 rotates so that pressing cylinder 54 fitted on the screw rod moves forwards along grooves 51*a*. Therefore, piston 53 located at the front end moves forwards so as to push out a liquid paint L stored in main body 51 toward application element 52 so that the liquid infiltrates into application element 52 and can be used for application.

Also in this applicator, rotary actuator 55 is prohibited from rotating in the reverse direction by ratchet mechanism 57, so that pressing cylinder 54 and piston 53 can only move forwards.

In the above way, in the conventional liquid applicators, since the rotation of rotary actuator 33 or 55 is converted into a linear movement of piston 41 or 53 so as to supply liquid paint L, it is possible to finely adjust the supplying amount and hence facilitate the working of a simple and appropriate application.

However, each of the above liquid applicators has the following problem because rotary actuator 33 or 55 is arranged in such a fitted manner as to slide and rotate with respect to main body 31 or 51 and the fitted portion is configured of annular fitting projection 33*a* or 55*a* formed on rotary actuator 33 or 55 and annular fitting recess 31*a* or 51*b* formed on main body 31 or 51.

That is, it is preferred that the depth of fitting recess 31*a* or 51*b* and the projected amount of fitting projection 33*a* or 55*a* should be set as large as possible in order to prevent rotary actuator 33 or 55 from dropping off from main body 31 or 51. However, since main body 31 or 51 usually has a thin-wall structure with polypropyrene or other resins for the necessity of being light-weighted and of inexpensive configuration, it is difficult to configure fitting recess 31*a* or 51*b* to be deep enough as stated above and hence it is impossible to provide a strong enough fitted portion. So, as an applicator of this kind which is often carried around, the conventional configurations are insufficient in their strength.

Nevertheless, rotary actuators 33 and 55 usually have a relatively thick-wall configuration. So, when this rotary actuator 33 or 55 is formed with a fitting projection 33*a* or 55*a* having a large projected amount and main body 31 or 51 is formed with a deep fitting recess 31*a* or 51*b*, a firm fitting engagement between rotary actuator 33 or 55 and fitting projection 33*a* or 55*a* can be configured thus making it possible to enhance the fitting strength of rotary actuator 33 or 55. In this case, however, sink arises on the surface of rotary actuator 33 or 55 at the site where fitting projection 33*a* or 55*a* is formed so as to be thick, markedly degrading its appearance, thus giving rise to difficulties in putting this configuration into effect.

In the applicator shown in FIGS. 26 and 27, a partition wall is formed on the inner face in the central part of main body 22, rotary actuator 33, screw rod 37 and the like have to be inserted from the rear of main body 22 while piston 41 needs to be fitted from the front end of main body 31. Further, piston 41 and screw rod 37 should be inserted from the front and rear and be joined inside the main body. Thus, the conventional configuration has the problem of the assembly operation being complicated and difficult, resulting in poor productivity. Moreover, since piston 41 is inserted into main body 31, the inside diameter of main body 31 needs to be equal to the diameter of piston 41, so that the inside diameter of main body 31 depends on piston 41. That is, there is a problem in that the dimensions and shape of main body 31 are limited thereby.

The present invention has been devised in view of the above prior art problems, and it is therefore an object of the invention to provide a liquid applicator in which the main body and rotary actuator are firmly fitted to each other whilst being rotatable, providing a high enough strength and good appearance and which is simple in assembly as well as being excellent in design flexibility.

DISCLOSURE OF THE INVENTION

In order to attain the above object, the present invention has the following configuration.

That is, a liquid applicator includes:

a cylindrical main body having a predetermined application element at the front end thereof;

a liquid pressing mechanism mounted to the main body for pushing a liquid paint stored in the main body forwards to supply the application element with the liquid paint, wherein the liquid pressing mechanism comprises:

a fixed cylinder having a cylindrical shape which is press fitted into the rear opening of the main body and fixed to the inner face of the main body and has cam grooves on the inner surface thereof and a female thread at the front end thereof;

a feed element having a cylindrical shape to be press fitted to the fixed cylinder so as to be rotatable, having a rotary actuator projected rearwards from the main body and an inserted portion located in front of the rotary actuator and inserted into fixed cylinder, the inserted portion having an extraordinarily shaped fitting hole at the front end thereof and having a cam portion formed of a cantilever spring on the peripheral surface thereof which engages the cam grooves so as to allow the rotary actuator to only rotate in one direction;

a screw rod having a cross-section substantially identical to that of the fitting hole in the feed element and fitted through the fitting hole so as to move in the longitudinal direction and so as not to be rotatable, and having a male thread on the peripheral surface thereof which is screw fitted with the female thread of the fixed cylinder; and a piston fixed to the front end of the screw rod projected forward from the female thread of the fixed cylinder and slidably inserted whilst maintaining a fluid-tight state with respect to the inner surface of the fixed cylinder, In the invention having the above configuration, when the rotary actuator of the feed element is turned in one direction, the screw rod rotates together with this. Since the male thread of the screw rod is screw fitted with the female thread formed in the front part of the fixed cylinder, the screw rod moves forward as it is guided by the female thread, so as to cause the piston, which is joined to the front end of the screw rod, to move forwards. As a result, the liquid paint stored in the main body is pushed forwards and supplied to the application element. Here, the feed element also rotates together with the rotation of the screw rod. However, the cam portion formed on the feed element is fitted and engaged with the cam grooves of the fixed cylinder which is fixed to the main body, so as to stop the reverse rotation. Therefore, the screw rod and rotary actuator only rotate in the forward direction.

Since the rotary actuator is adapted to be fitted to the annular fitting portion of the fixed cylinder inserted in the main body, instead of being fitted to the main body, it is possible to set up a desired fitting structure between the rotary actuator and the fixed cylinder depending upon the needed strength, without affecting the shape and configuration of the main body.

Further, the liquid pressing mechanism can be assembled markedly easily because the constituents such as the fixed cylinder, feed element, screw rod, piston and the like can all be inserted from the rear of the barrel body. Accordingly, all the constituents may be assembled first outside the barrel body so that the thus unit-assembled liquid pressing mechanism can be inserted altogether from the rear of the barrel body. Thus, it is possible to enhance the efficiency of the assembly work. Further, the shape of the front part of the main body can be designed regardless of the configurations of the piston, etc., so that the design flexibility can be markedly improved.

By forming slits for separating the rear part of the feed element from the rear end to the predetermined forward position in the fixed cylinder, the fixed cylinder and the feed element can be easily fitted to each other and the parting performance during molding of the fixed cylinder can be enhanced.

As the application element, a brush element having a large number of hairs bounded at one end may be used or a configuration which comprises a brush member having a large number of bristles are implanted on a holder, comb teeth planted upright around the brush member and a flow channel for establishing communication between the main body side and the bristle side with respect to the holder can be considered.

BRIEF DESCRIPTION OF THE DRAWINGS

FIG. 8(*a*) is a vertical sectional side view of that shown in FIG. 7, (b) is a rear view of that shown in FIG. 7;

FIG. 13 is a vertical sectional side view showing that shown in FIG. 12(*a*);

FIG. 14 is a sectional view taken along a line A—A in FIG. 12(*a*);

FIG. 15 is a sectional view taken along a line B—B in FIG. 12(*a*);

FIG. 16 is an enlarged vertical sectional side view showing the crown shown in FIG. 3; (b) being a front view of (a);

FIG. 17 is a partial vertical sectional side view of the front barrel shown in FIG. 3, (b) is a rear view showing that shown in (a);

FIG. 19 is a view showing another example showing a fixed cylinder applied to the above embodiment, (a) being a vertical sectional side view; (b) a sectional view taken along a line B—B of that shown in (a) and (c) a sectional view taken along a line A—A of that shown in (a);

BEST MODE FOR CARRYING OUT THE INVENTION

Referring hereinbelow to FIGS. 1 through 25, embodiments of the liquid applicator in accordance with the present invention will be described.

Figure 1:
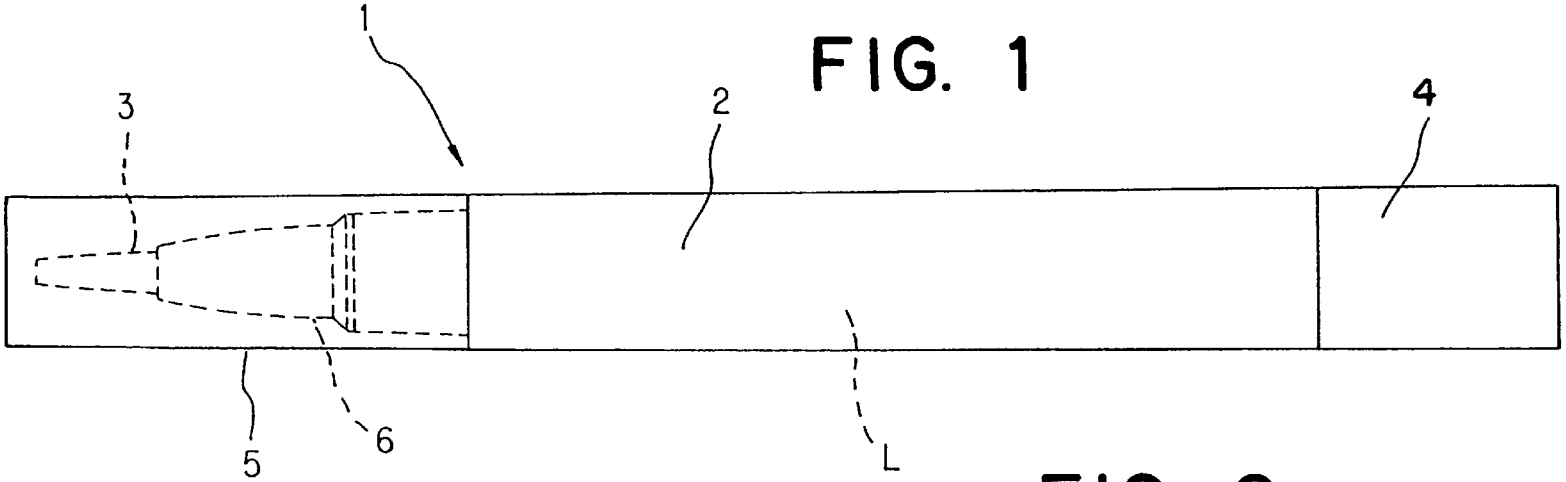
FIG. 1 is a side view showing the overall configuration of the first embodiment of a liquid applicator in accordance with the present invention.

FIG. 1 is a side view showing the external configuration of the first embodiment of the present invention.

As shown in FIG. 1, liquid applicator 1 in the first embodiment is configured of a hollow cylindrical main body 2 for storing an application liquid L, an application element 3 attached to the front end of main body 2, a liquid pressing mechanism 4 for pressing application liquid L forwards against application element 3 and a cap 5 for covering the application element. Liquid pressing mechanism 4 includes: a fixed cylinder 11; a feed element 12; a screw rod 13; and a piston 14.

Figure 2:
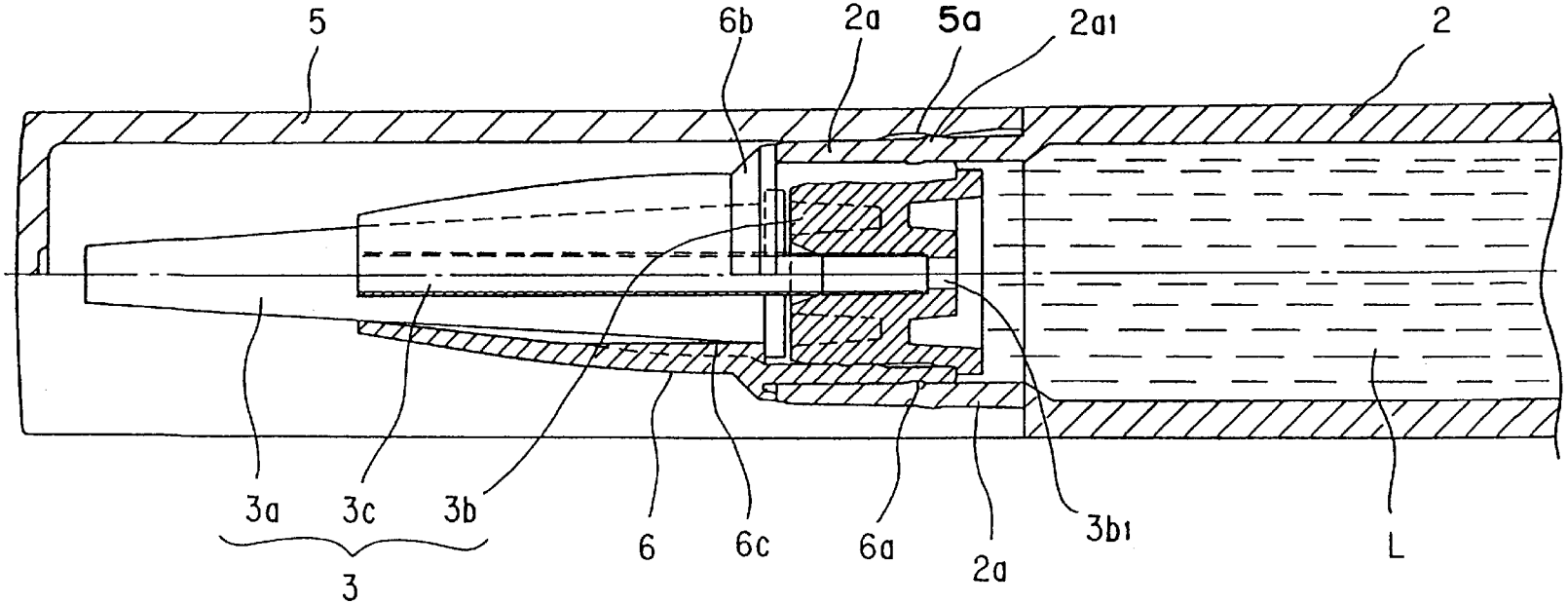
FIG. 2 is a vertical sectional side view showing the front half of that shown in FIG. 1.
Figure 3:
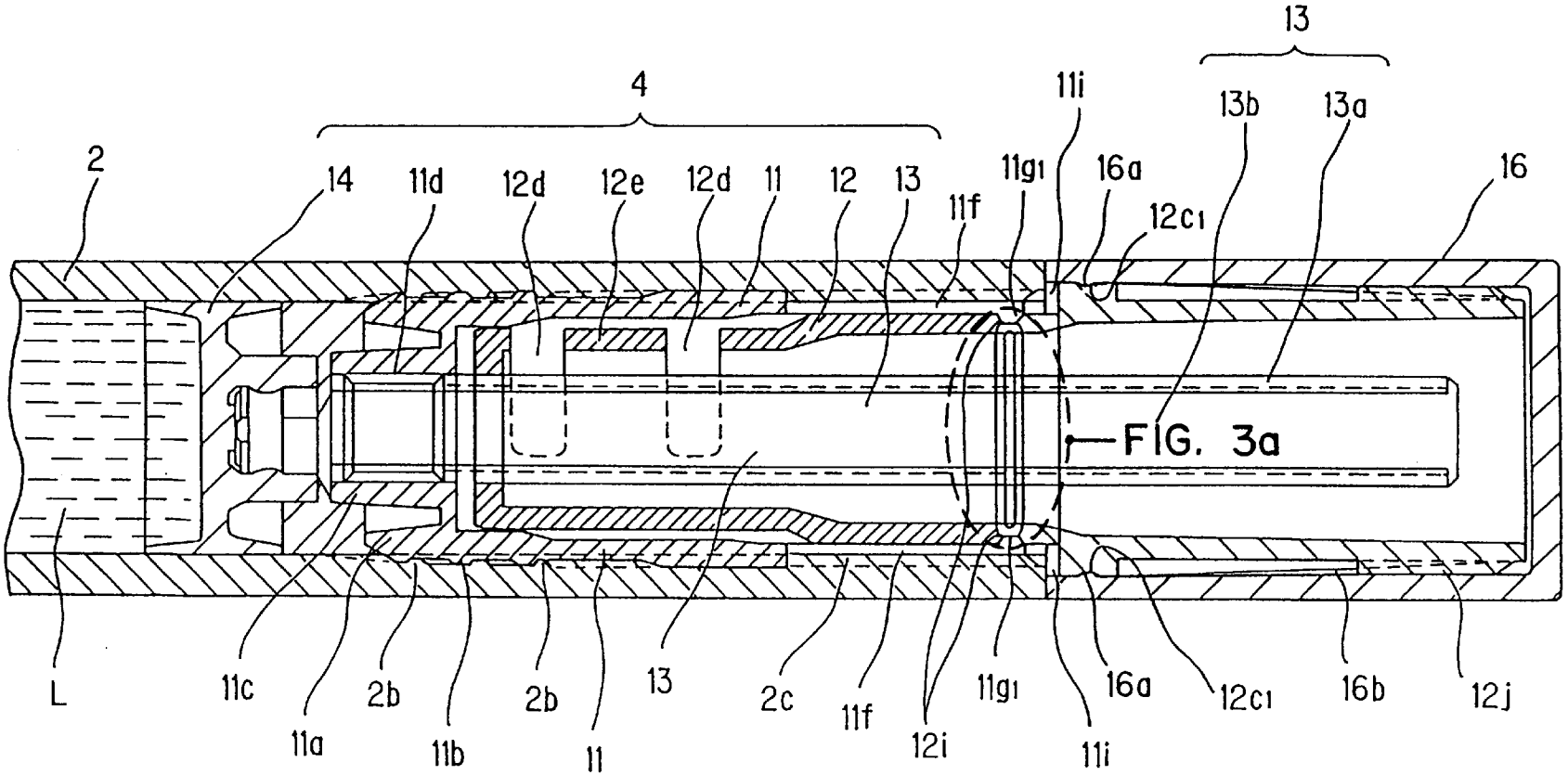
FIG. 3 is a vertical sectional side view showing the rear half of that shown in FIG. 1.
Figure 4:
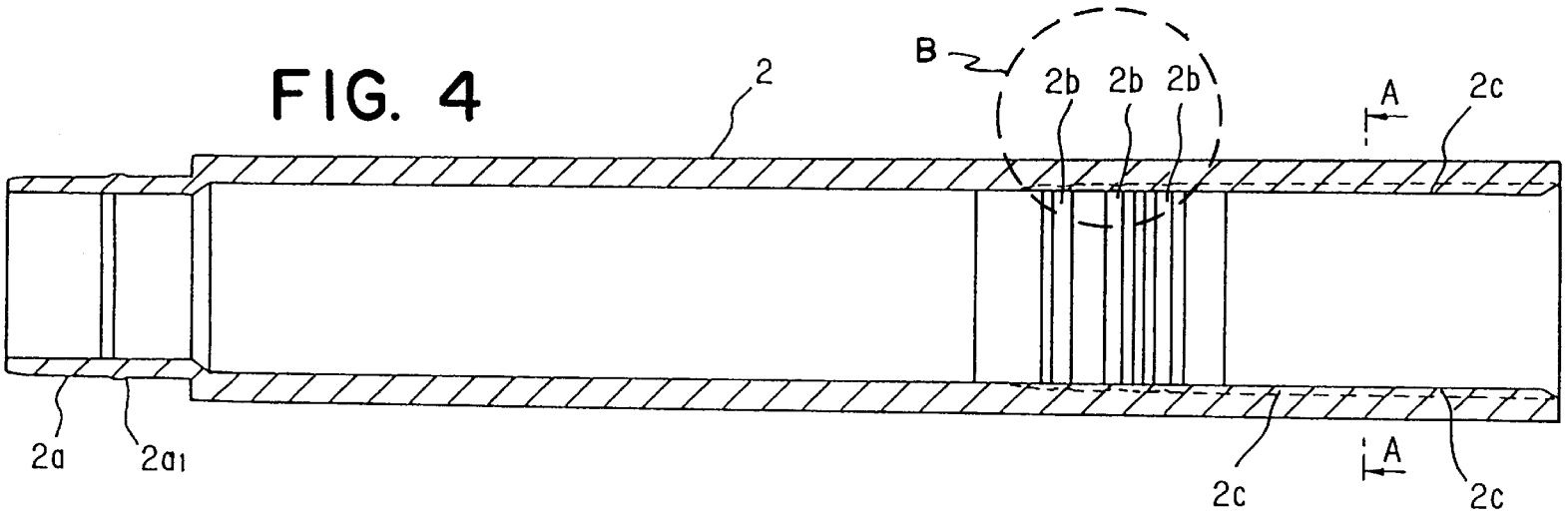
FIG. 4 is a vertical sectional side view showing the main body shown in FIGS. 2 and 3.

Main body 2 has the shape and configuration shown in FIGS. 2 to 4. Specifically, main body 2 is of a cylinder having a small-diametric portion 2*a* at the front end thereof having an approximately equal outside diameter to the inside diameter of cap 5 so that cap 5 fits thereon. Formed on the outer peripheral surface of small-diametric portion 2*a* is, as shown in FIG. 2, a projection 2*a*1 which is mated with a recess 5*a* formed on the inner surface of cap 5. This mating between recess 5*a* and projection 2*a*1 provides for prevention of cap 5 from dropping off unintentionally from small-diametric portion 2*a*.

Figure 5:
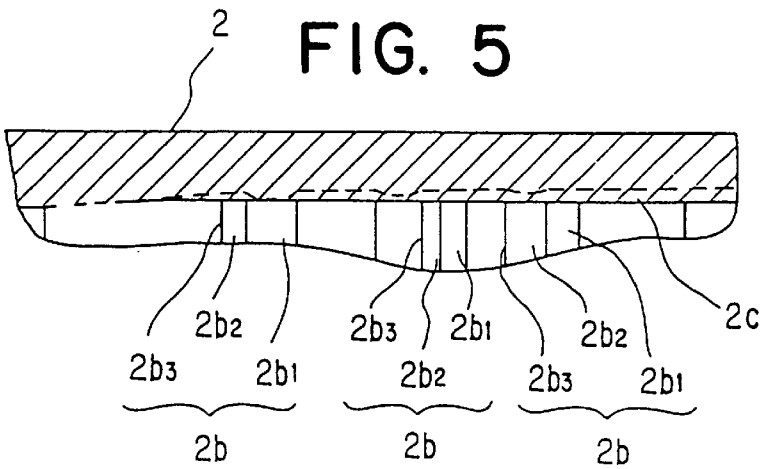
FIG. 5 is an enlarged view of the B portion shown in FIG. 4.

Further, a projection 6*a* which engages an aftermentioned front barrel 6 is formed on the inner surface of small-diametric portion 2*a*, while multiple projections 2*b* are formed, as shown in FIGS. 3 and 4, on the inner surface at the rear part of main body 2. Each projection 2*b* has, as shown in FIG. 5, a gentle slope 2*b*1 which gently rises inwards from the rear to the front, a flat surface 2*b*2 continuous from this gentle slope 2*b*1 and a steep portion 2*b*3 which steeply falls outwards from this flat portion 2*b*2, nearly at right angles therewith. Thus, fixed cylinder 11 is press fitted and engaged. Here in FIG. 3, numeral 11*g*1 indicates fitting projection which normally can not be seen in FIG. 3; nevertheless, the fitting projection 11*g*1 is shown here in broken lines by looking perspectively through the feed element 12.

Figure 6:
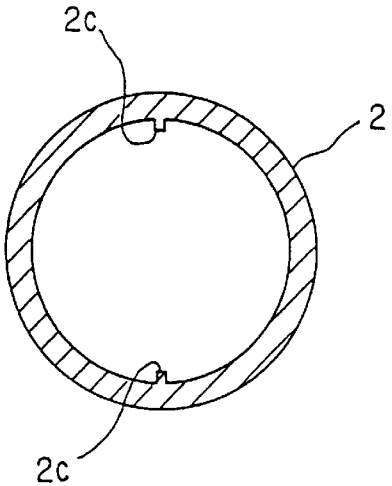
FIG. 6 is a vertical section taken along a line A—A shown in FIG. 4.
Figure 3A:
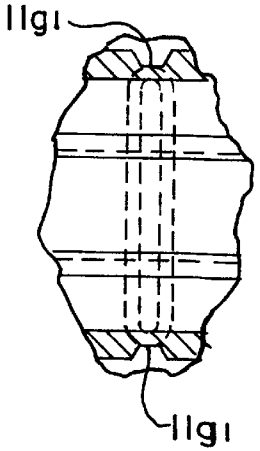
FIG. 3*a* is an exploded view of a portion of FIG. 3.

As shown in FIG. 6, which is an enlarged view taken along a line A—A shown in FIG. 4, ribs 2*c*, extending in the longitudinal direction from the rear end to the front of projections 2*b*, are formed on the inner peripheral surface of main body 2.

Further, the fixed cylinder has a configuration as shown in FIGS. 7 through 11.

That is, provided on the outer periphery of the front half of fixed cylinder 11 are multiple projections 11*b* which can be press fitted so as to mate the projections and indentations 2*b* of main body 2. In contrast to projected portions 2*b* of main body 2, each projection 11*b* has a gentle slope 11*b*1 which gently inclines so as to project inwards from the front to the rear, a flat portion 11*b*2 continuous from the peak of this gentle slope 11*b*1 and a steep portion 11*b*3 which steeply drops inwards from this flat portion 11*b*2, nearly at right angles therewith. Therefore, steep portion 11*b*3 abuts steep portion 2*b*3 of projection 11*b* of main body 2 so as to prevent detachment from main body 2.

Figure 7A:
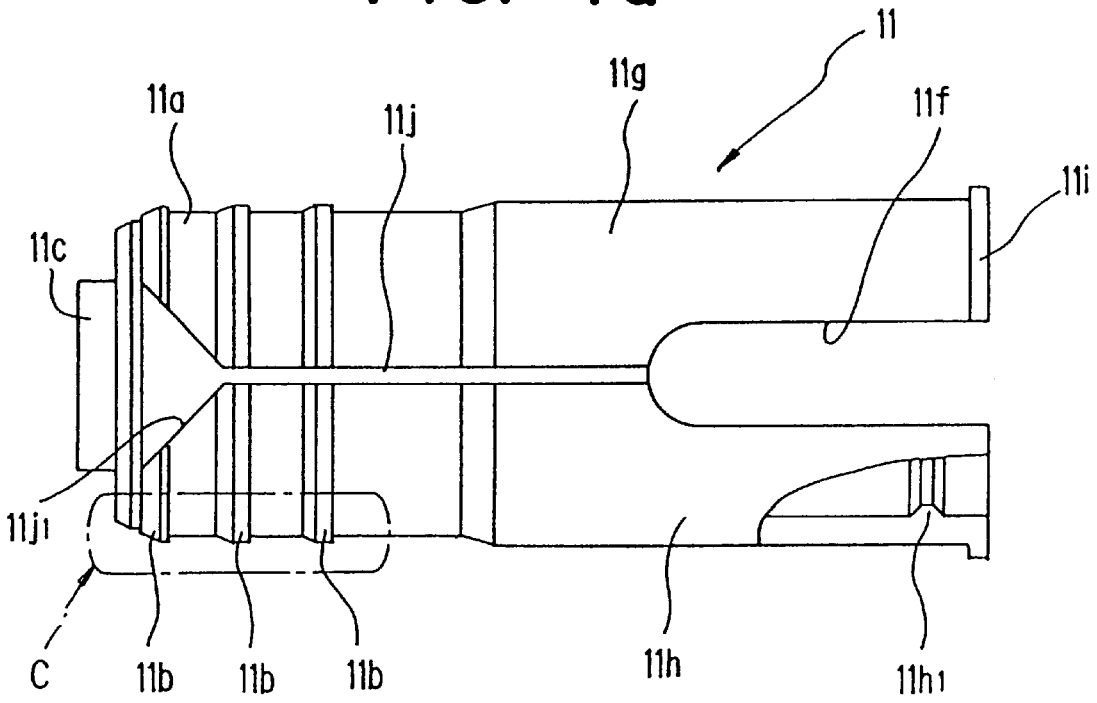
FIG. 7 is a view showing a fixed cylinder shown in FIG. 3, (a) being a plan view and (b) a front view of (a)
Figure 7B:
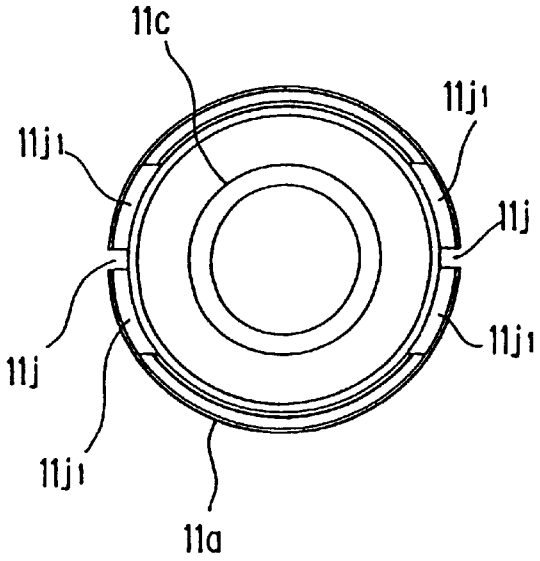

The front portion of fixed cylinder 11 has a double cylindrical configuration of an outer cylinder 11*a* having the aforementioned projections and an inner cylinder 11*c* (see FIG. 7(*b*)). Formed on the inner surface of inner cylinder 11*c* is a female thread 11*d* as shown in FIG. 8(*a*). Further, as shown in FIG. 8(*b*) and FIG. 10, many cam grooves 11*e* having a saw-toothed cross-section are formed on the inner surface in the middle part of fixed cylinder 11.

The rear half of fixed cylinder 11 is branched into a pair of legs 11*g* and 11*h* each having an arc shape, by a pair of slits 11*f* cut out at top and bottom. An arc shaped flange 11*i* is projected outwards from the outer peripheral surface at the rear end of each of legs 11*g* and 11*h* while arc shaped fitting projections 11*g*1 and 11*h*1 are projected from the inner surface of each of legs 11*g* and 11*h*. The flange 11*i* abuts the rear end face of main body 2, while the fitting projections 11*g*1 and 11*h* 1 are mated into an annular fitting recess 12*i* of the feed element 12.

Rotational stopper grooves 11*j* are cut on the outer periphery of fixed cylinder 11 from the innermost position of slit 11*f* to the front end of the cylinder. Ribs 2*c* of the main body 2 are mated into rotational stopper grooves 11*j*. The front part 11*j*1 of this rotational stopper groove 11*j* is set open at a predetermined angle.

In this manner, fixed cylinder 11 is prohibited from moving rearwards with respect to main body 2 by the engagement between its steep portion 11*b*3 and steep portion 2*b*3 of main body 2 while it is prohibited from rotating relative to main body 2 by the engagement between ribs 2*c* and rotational stopper grooves 11*j*. Further, the fixed cylinder is prohibited from moving forward with respect to main body 2 by the abutment of flange 11*i* against the rear end of main body 2. Thus, the fixed cylinder is securely fixed to main body 2.

FIGS. 12 through 15 are views showing the aforementioned feed element 12.

This feed element 12 is integrally formed of a cylindrical projected portion 12*a* inserted into the rear end of main body 2 and a cylindrical inserted portion 12*b* which is inserted in main body 2. Projected portion 12*a* has an annular flange 12*c* with a concave arced surface 12*c*1 formed on the peripheral side thereof. Formed on the front end face of inserted portion 12*b* is a fitting hole 12*h* defined by arced portions 12*h*1 and linear line portions 12*h*2. Inserted portion 12*b* also has a U-shaped slit 12*d* on the peripheral surface in the front part thereof. The portion enclosed by this slit 12*d* constitutes a cantilever spring, namely, resilient piece 12*e*.

Formed at the front part of this resilient piece 12*e* is a cam portion 12*f*, which has an acute-angled cross section projecting outwards as shown in FIGS. 14 and 15 and engages the aforementioned cam groove 11*e*. Further the annular fitting recess 12*i* is formed in the rear part of inserted portion 12*b*. This fitting recess 12*i* mates with fitting projections 11*g*1 and 11*h*1 which are formed on legs 11*g* and 11*h* of fixed cylinder 11. Therefore, feed element 12 is rotatable but is prohibited from moving back and forth with respect to fixed cylinder 11.

Formed 180° apart from each other on the outer peripheral surface in the rear end of projected portion 12*a* of feed element 12 is a pair of engaging projections 12*j* having a triangular cross-section. Further a cylindrical crown 16 shown in FIG. 16 is fitted on the outer peripheral surface of this feed element 12. This crown 16 has an annular projection 16*a* on the inner surface near the front side thereof. This annular projection 16*a* is mated with concave arced surface 12*c*1 of flange 12*c* of feed element 12 so as to prevent the crown from dropping off from feed element 12. Also a number of engaging projections 16*b* having triangular cross-sections are formed the predetermined distance apart from each other, on the inner peripheral surface of crown 16. The aforementioned engaging projections 12*j* of feed element 12 are inserted between engaging projections 16*b* so that crown 16 and feed element 12 substantially integrally rotate by the abutment between the two engaging projections 12*j* and 16*b*. In this embodiment, crown 16 and projected portion 12*a* of feed element 12 constitute the rotary actuator.

Inserted into extraordinarily shaped fitting hole 12*h* formed in the front face of feed element 12 is a screw rod 13 having an approximately similar cross-section thereto. This screw rod 13 has a pair of male thread portions 13*a* formed on the arced surface thereof and flat portions 13*b* formed between the male thread portions 13*a*, and is inserted into fitting hole 12*h* so that it can move in the longitudinal direction while being prohibited from rotating. Attached to the front end of screw rod 13 is a piston 14. This piston 14 is disposed slidable along the inner surface of main body 2 while maintaining its fluid-tight state.

FIG. 17 is a view showing the shape of the aforementioned front barrel 6. This front barrel 6 is a tapered cylinder, that is, its diameter becoming narrower toward the front end. An annular fitting recess 6*a* is formed on the outer periphery in the rear part of the front barrel. This fitting recess 6*a* is press fitted into annular fitting projection 2*a*1 formed on the inner surface of small-diametric portion 2*a* in main body 2 so as to prevent the main body from dropping off from front barrel 6. Front barrel 6 has a flange 6*b* on the outer periphery thereof and this flange 6*b* abuts the front end face of the aforementioned small-diametric portion.

Figure 18:
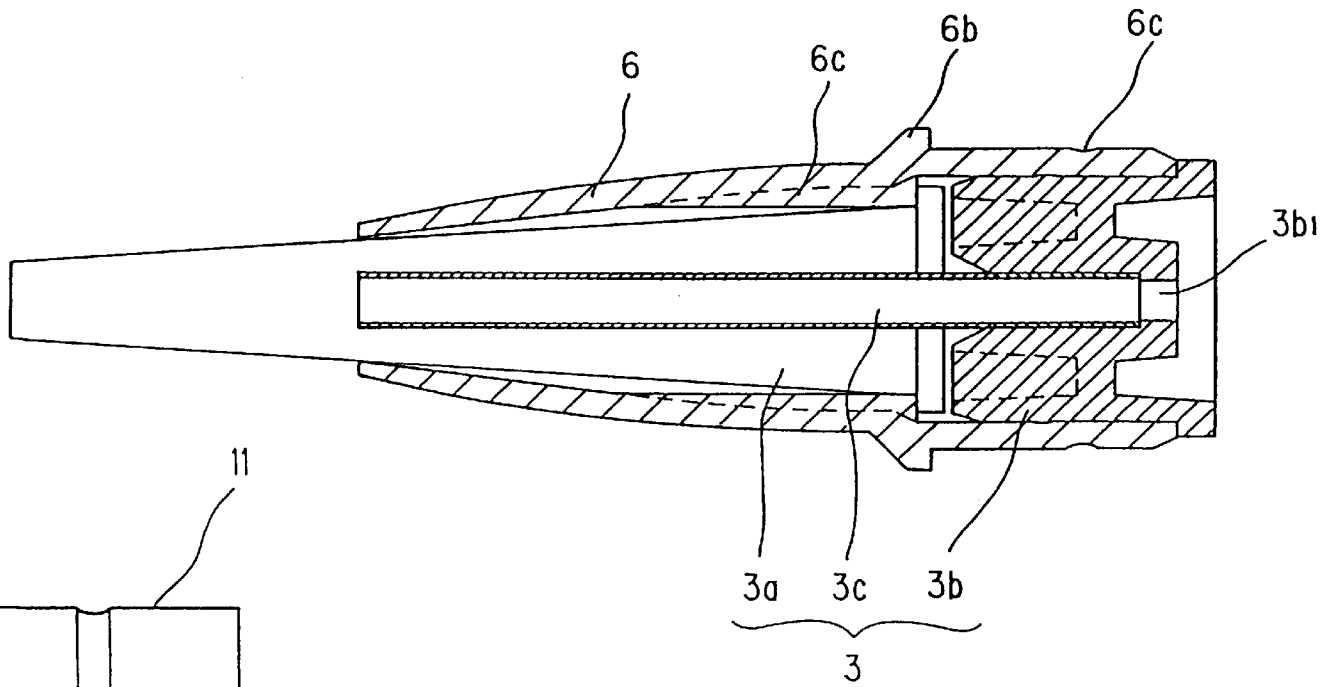
FIG. 18 is a vertical sectional side view showing the front barrel and application element shown in FIG. 3.
Figure 21:
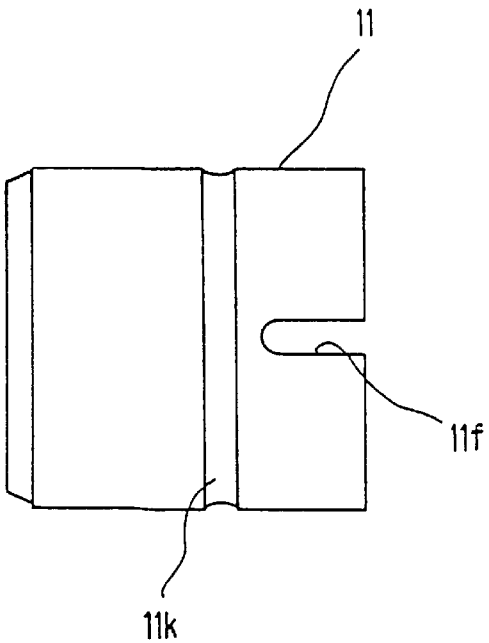
FIG. 21 shows the fixed cylinder shown in FIG. 20.

Further, a multiple number (six, here) of ribs 6*c* extending longitudinally are formed on the inner surface of front barrel 6, equi-distantly from one another, so that these ribs 6*c* will hold the rear part of application element 3 between holders 3*b* (see FIG. 18).

Application element 3 in this embodiment, is composed of a brush portion 3*a* which is formed by binding a large number of resin-made hairs at their rear end by heat-melt-binding, the annular holder 3*b* press fixed to the inner surface of front barrel 6, and an application liquid conduit pipe (flow channel) 3*c* which is fitted through a passage hole 3*b*1 in the center of holder 3*b* and fixed thereto and inserted from the center of the rear end part of the hairs to the middle part thereof.

When liquid applicator 1 of the above configuration is assembled, application liquid pressing mechanism 4 is first assembled outside main body 2, in the following manner.

That is, screw rod 13 is screw fitted into female thread 11*d* of fixed cylinder 11 up to the predetermined position so that piston 14 is press fitted and fixed to the front end of the screw rod, projected forward from female thread 11*d*. Then, feed element 12 is press fitted into the fixed cylinder 11 whilst the part of screw rod 13 projected to the rear from fixed cylinder 11 is passed through fitting hole 12*h*. Finally, fitting projections 11*g*1 and 11*h*1 formed in the legs 11*g* and 11*h* of fixed cylinder 11 are fitted into the fitting grooves 12*i*. Thereafter, crown 16 is fitted so as to cover the outer periphery of projected portion 12*a* of feed element 12, and an annular projection 16*a* in crown 16 is mated with concave arced surface 12*c*1 of flange 12*c* in feed element 12 so as to fix crown 16 to feed element 12. This completes the assembly of application liquid pressing mechanism 4.

The thus unit-assembled application liquid pressing mechanism 4 is inserted into the opening formed in the rear end of main body 2, progressively from its front part, i.e., piston 14, until rotational stopper grooves 11*j* of fixed cylinder 11 fit ribs 2*c* of main body 2 and projections 11*b* on fixed cylinder 11 engage projections 2*b* on the inner surface of main body 2 so that fixed cylinder 11 is fully inserted into main body 2. At this point, the front opening rim of crown 16 abuts the rear opening rim of main body 2, whereby insertion of application liquid pressing mechanism 4 into main body 2 is completed.

Since the front part of each rotational stopper groove 11*j* in this embodiment opens with a certain width, when fixed cylinder 11 is inserted with each rib 2*c* positioned in alignment within the width, ribs 2*c* are guided to the front part of stopper grooves 11*j* and positively fitted into stopper grooves 11*j*. Further, fixed cylinder 11 has slits 11*f* which provide for flexibility for the peripheral walls of the cylinder, so this configuration facilitates easy press-fitting of it into main body 2.

Next, a proper amount of application liquid is injected from the opening of small-diametric portion 2*a* formed at the front end of main body 2, then front barrel 6 with application element 3 inserted therein is press fitted into the inner surface of small-diametric portion 2*a* of main body 2. Thereafter, fitting projection 2*a*1 formed in the inner surface and the fitting recess 6*a* of front barrel 6 are mated with each other to thereby fix front barrel 6. Finally, when cap 5 is fitted to small-diametric portion 2*a*, this completes the assembly of the liquid applicator.

In this embodiment, crown 16, main body 2 and cap 5 all are formed with the same outside diameter, so the applicator presents a clean appearance having a rather small-diametric cylindrical surface continuous from the front to the rear.

In this way, in this embodiment, since it is possible to easily assemble the entire assembly of liquid pressing mechanism 4 into main body 2 by inserting it from the rear opening of main body 2, the work can be simplified. Besides, since liquid pressing mechanism 4 can be assembled beforehand as a unit outside main body 2, it is possible to improve the efficiency of the manufacturing process.

In the above arrangement of liquid applicator 1, when crown 16 located behind main body 2 is turned in a constant direction (in the clockwise direction), the application liquid in the main body can be supplied to the application element. More specifically, as crown 16 is turned clockwise relative to main body 2, feed element 12 rotates in the same direction and hence screw rod 13 which is inserted into extraordinarily shaped fitting hole 12*h* of this feed element 12 also rotates. Since male thread 13*a* of this screw rod 13 is screw fitted with female thread 11*d* of fixed cylinder 11, screw rod 13 moves forward as it rotates clockwise by virtue of screw engagement. As a result, piston 14 which is joined to the front end of screw rod 13 moves forwards so as to push liquid paint L stored in main body 2 forwards and supply brush portion 3*a* with the paint from passage hole 3*b*1 of holder 3*b* by way of pipe 3*c*. Thus, brush portion 3*a* is ready for application. Here, since application element 3 in this embodiment is formed with brush portion 3*a*, this configuration is markedly effective in performing fine application such as lip coloring, eyebrow coloring, etc.

In the aforementioned feed element 12, upon rotation of crown 16, cam portion 12*f* formed at the distal end of resilient piece 12*e* continuously presses saw-toothed cam groove 11*e* formed on the fixed cylinder 11. When crown 16 is rotated, cam portion 12*f* strikes on and, slides along, the rear part of the inclined surface of cam groove 11*e* and then drops into and abuts the front end of the next inclined surface. This movement will be repeated with a predetermined pitch of rotation. During this, the resilient force of the resilient piece alternately increases and decreases, so this movement produces a clicking sensation to the operator and also produces a clicking sound by the abutment between cam portion 12*f* and inclined surface 11*e*1 when the resilient force is released. Therefore, the operator can recognize, form the clicking feeling or clicking sound, the angle of rotation of the crown and hence the supplied amount of application liquid Land can make an easy adjustment of the supplied amount. Since the front end of inclined surface 11*e*1 is formed with a curved surface (with R), a feeling of smooth upward sliding is obtained when cam portion 12*f* slides upward from the front edge of inclined surface 11*e*1 to the middle part thereof as crown 16 is rotated.

Since cam portion 12*f* of resilient piece 12*e* continuously abuts a stopper face 11*e*2 of fixed cylinder 11 of cam groove 11*e*, the rotation in the counterclockwise direction is prohibited by the abutment between cam portion 12*f* and stopper face 11*e*2 even if crown 16 is attempted to be rotated counterclockwise upon rotational actuation. Therefore, screw rod 13 will not turn counterclockwise and hence screw rod 13 and piston 14 will not move rearwards either. Accordingly, once liquid paint L is ejected outside, it will never flow in the reverse direction into pipe 3*c* of application element 3 or into main body 2, thus making it possible to prevent the liquid inside main body 2 from being contaminated by germs, etc. Since stopper face 11*e*2 rises substantially upright, cam portion 12*f* is positively stopped by stopper surface 11*e*2 so that the operator obtains a definite feeling of the rotational stopper when a counterclockwise rotation is attempted.

Feed element 12 is fitted to annular fitting projections 11*g*1 and 11*h*1 of fixed cylinder 11 fixed inside main body 2, instead of being directly fitted to main body 2. Therefore, it is possible to set up a desired fitting structure between fixed cylinder 11 and feed element 12 depending upon the needed strength without affecting the shape and configuration of main body 2. Therefore, main body 2 may be formed of a thin-walled configuration in order to produce a light-weighted product and may be formed of polypropyrene or other resins which are inexpensive and have flexibility. In contrast, when fixed cylinder 11 is formed of a hard material such as ABS (acrylonitrile-butadiene-styrene), polycarbonate, polyacetal, PBT (polybutylene terephthalate) and the like so that fitting projections 11*g*1 and 11*h*1 can have a relatively large projected height while feed element 12 is formed with relatively deep fitting recesses 12*i* mating the fitting projections 11*g*1 and 11*h*1, it is possible to produce a reliable fitting between fixed cylinder 11 and feed element 12 and hence provide a high enough strength for liquid applicator 1. In this case, there is a possibility of fixed cylinder 11 having sink at the forming positions of fitting projections 11*g*1 and 11*h*1. However, since fixed cylinder 11 is not exposed externally, the sink marks arising here will not cause any appearance problem. As the material of feed element 12, polyacetal is most preferable in view of spring elasticity, creep resistance, and fatigue resistance.

Moreover, in this embodiment, since fixed cylinder 11 has slits 11*f* and therefore legs 11*g* and 11*h* formed therein, producing relatively large flexibility, legs 11*g* and 11*h* can be opened when feed element 12 is inserted thereinto so that press fitting and mating can be performed with a relatively small force. Therefore, this configuration facilitates easy manual assembly even for a weak worker without using any pressing machine or the like. Suppose that there are no slits 11*f*, the flexibility of the fixed cylinder is very low, so that it is impossible to insert feed element 12 unless a considerably high pressing force is added, which means the necessity of a pressing machine or the like, causing increase of equipment on the production line.

Further, formation of the aforementioned slits 11*f* also simplifies molding of fixed cylinder 11. That is, since fitting projections 11*g*1 and 11*h*1 can be formed with a large enough projected amount, it is possible to create a further increased strength in fitted state with feed element 12.

Illustratively, it is usually necessary to forcibly pull out the core pin which has been inserted in fixed cylinder 11 during its molding step. When the fixed cylinder has a configuration with slits as stated above, the core pin can be smoothly pulled out by opening legs 11*g* and 11*h* because legs 11*g* and 11*h* have large flexibility as stated above, which leads to improvement of the productivity and prevention of damage to the interior surface of fixed cylinder 11. Therefore, it is possible to set a considerably large projected amount for fitting projections 11*g*1 and 11*h*1, and consequently, it is possible to enhance the fitting strength with fitting recesses 12*i* of feed element 12. In connection with this, once the unit made up of fixed cylinder 11, feed element 12, screw rod 13 and the like is press fitted into main body 2, the outer periphery of fixed cylinder 11 is enclosed by main body 2 while the inner periphery is filled up with feed element 12. Therefore, even with slits 11*f*, legs 11*g* and 11*h* will not expand outwards or contract inwards, the fitted state of fixed cylinder 11 with respect to main body 2 and feed element 12 will be firmly maintained.

In the above description, an example where liquid pressing mechanism 4 is assembled outside main body 2 has been illustrated, but it is also possible to assemble the components of liquid pressing mechanism 4 as they are individually inserted into main body 2. In this case, the order of assembly may be modified appropriately as required. Also in the case where the components are assembled as they are individually inserted into main body 2, the provision of slits 11*f* in fixed cylinder 11 makes it possible for easy insertion of fixed cylinder 11 into main body 2.

Figure 9:
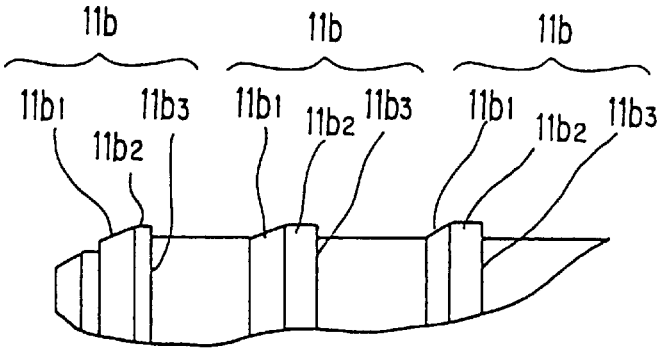
FIG. 9 is an enlarged view of the C portion shown in FIG. 7.
Figure 10:
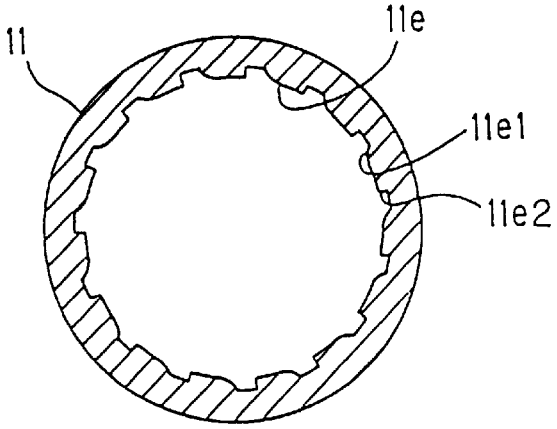
FIG. 10 is a sectional view taken along a line A—A in FIG. 8(*a*)
Figure 11:
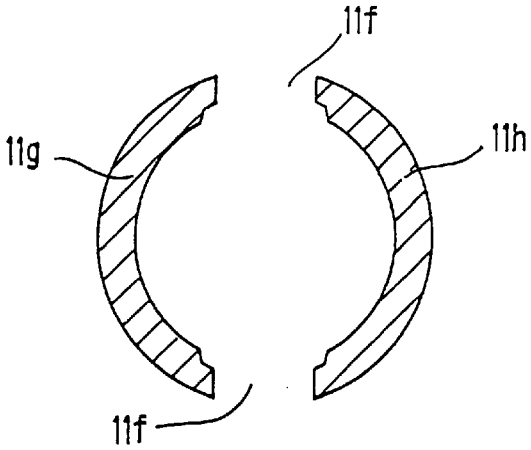
FIG. 11 is a sectional view taken along a line B—B in FIG. 8(*a*)
Figure 12A:
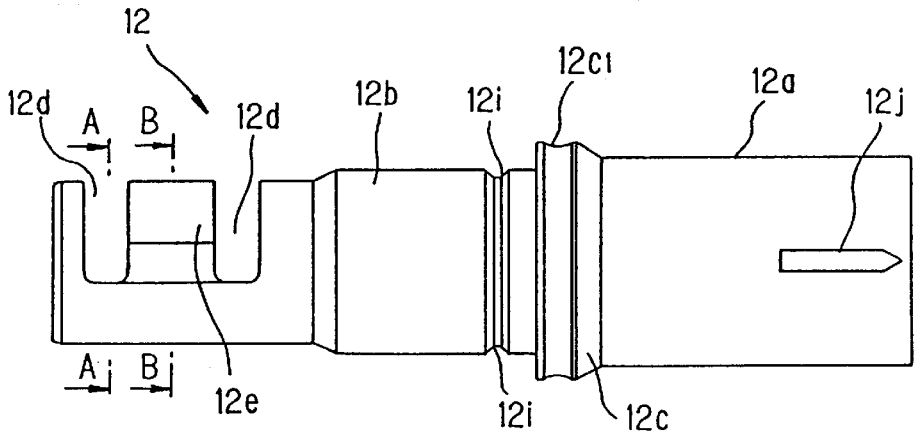
FIG. 12 is a view showing the shape of a feed element shown in FIG. 3, (a) being a side view, (b) a front view, (c) a rear view and (d) a bottom view.
Figure 12B:
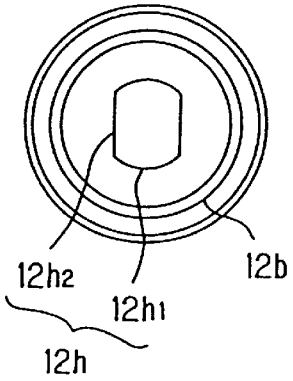
Figure 12C:
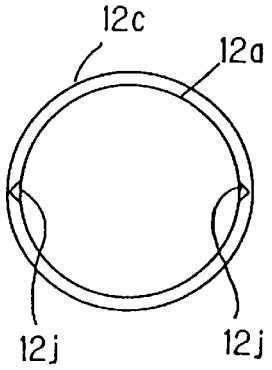
Figure 12D:
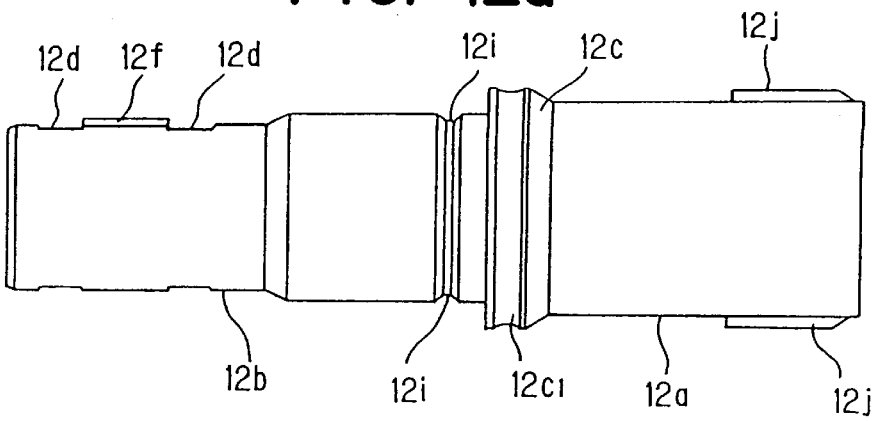

In the above first embodiment, saw-toothed cam grooves 11*e* engaging cam 12*e* of feed element 12 are formed in the inner surface of fixed cylinder 11 so as to permit feed element 12 to be rotated smoothly in a forward direction with a relatively small force whilst prohibiting the reverse rotation thereof. However, it is also possible to configure cam grooves 11E with a rectangular U-shaped cross-section in the inner surface of fixed cylinder 11 as shown in FIGS. 19(*a*), (b) and (c). This configuration also prevents reverse rotation of feed element 12 by the engagement of cam 12*e* and permits only one-way rotation. However, in this case, the rotation in the one direction of feed element 12 needs a relatively large force. So, application of cam grooves 11E is suitable if unintentional rotation needs to be prohibited. Other shapes and configurations in this fixed cylinder 11A are the same as shown in FIGS. 8 through 10, and in the drawings, the same or corresponding components are allotted with the same reference numerals.

Figure 20A:
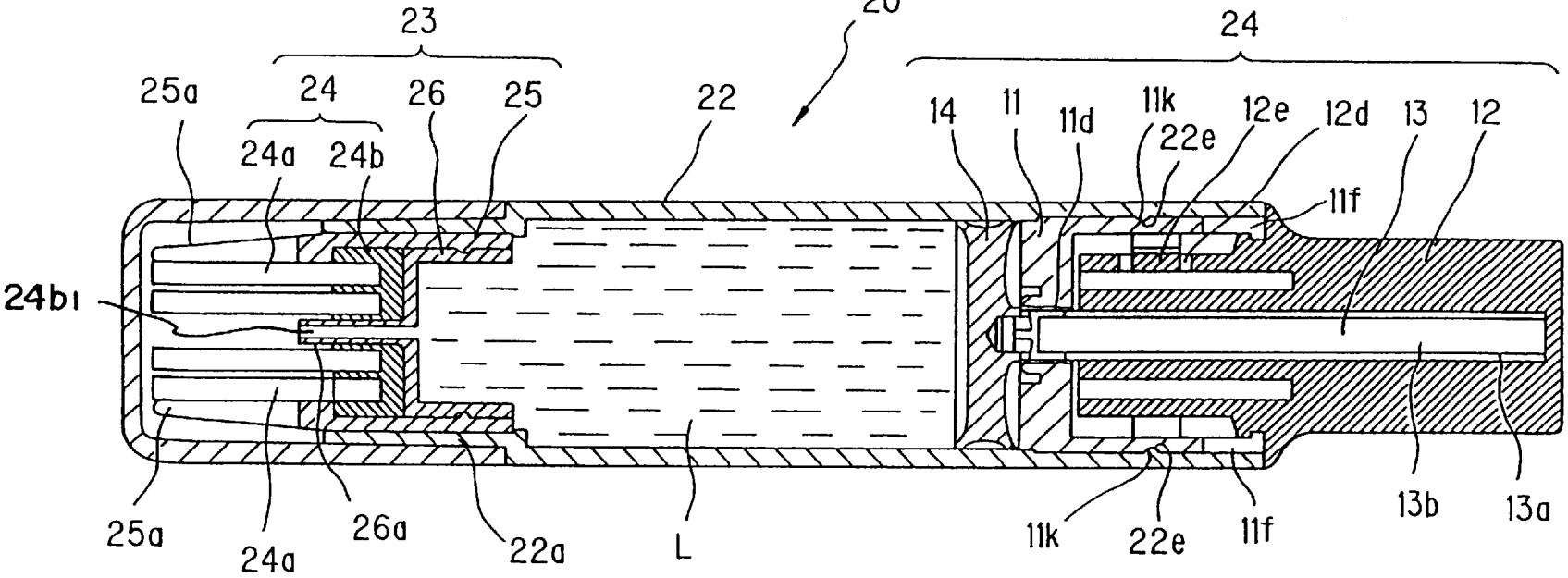
FIG. 20(*a*) is a vertical sectional side view showing the second embodiment and (b) is a front view of the application element shown in (a)
Figure 20B:
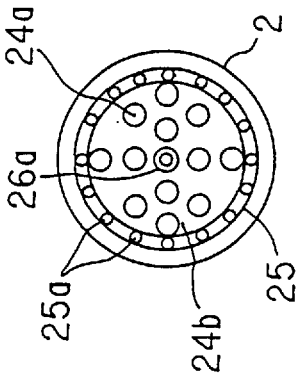
Figure 22:
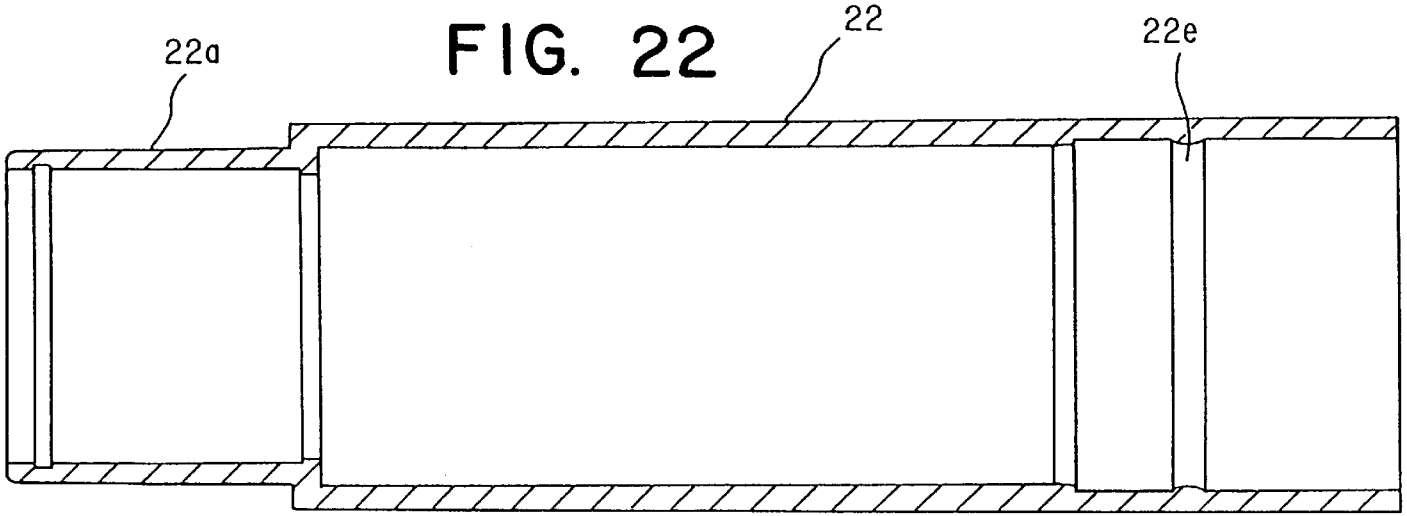
FIG. 22 is a vertical sectional side view showing the main body shown in FIG. 20.
Figure 23B:
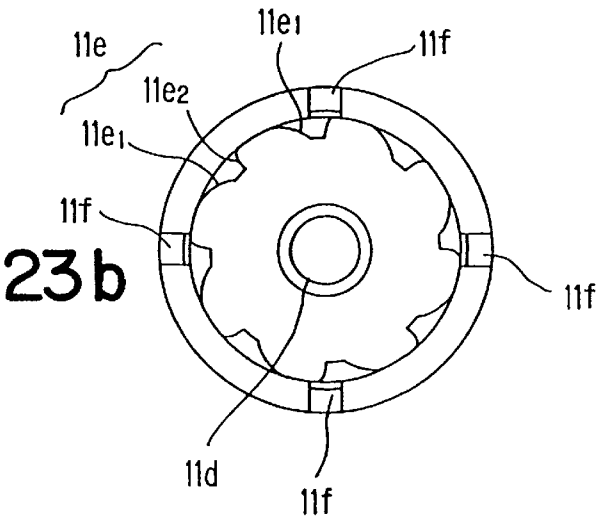
FIG. 23(*a*) is a vertical sectional side view of that shown in FIG. 21, (b) being a rear view of that shown in (a)
Figure 23A:
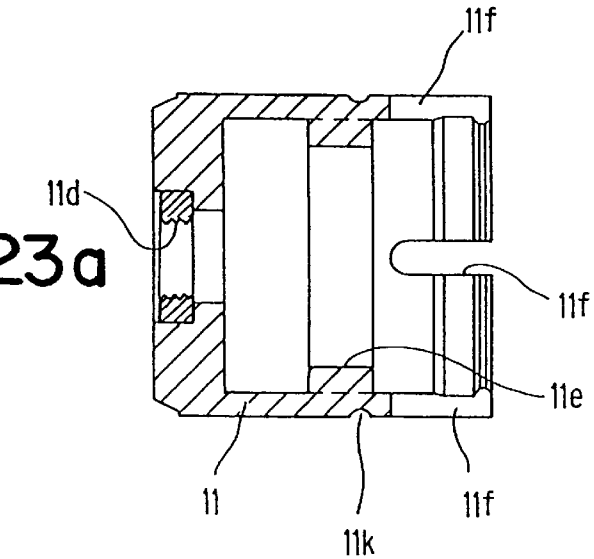
Figure 24A:
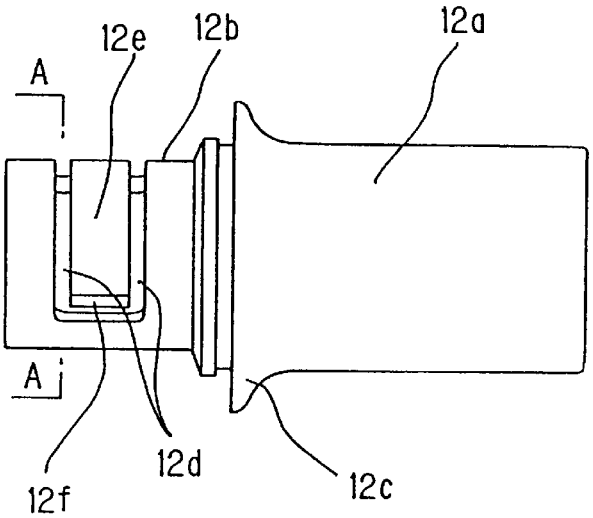
FIG. 24(*a*) is a side view showing the feed element shown in FIG. 20, (b) being a sectional view taken along a line A—A of (a)
Figure 24B:
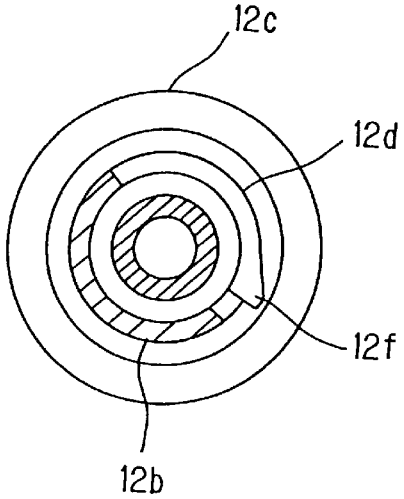
Figure 25A:
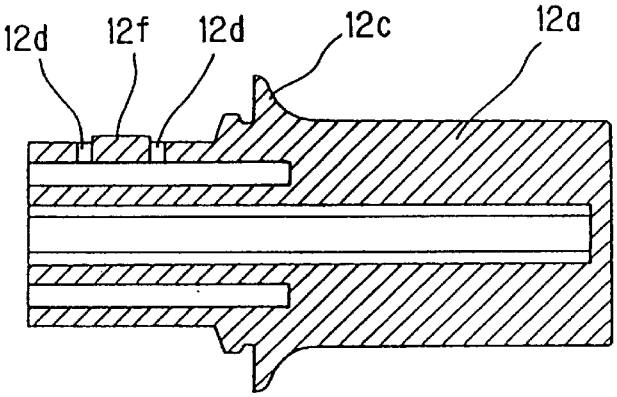
FIG. 25(*a*) is a vertical sectional side view showing that shown in FIG. 24, (b) being a front view of that shown in (a)
Figure 25B:
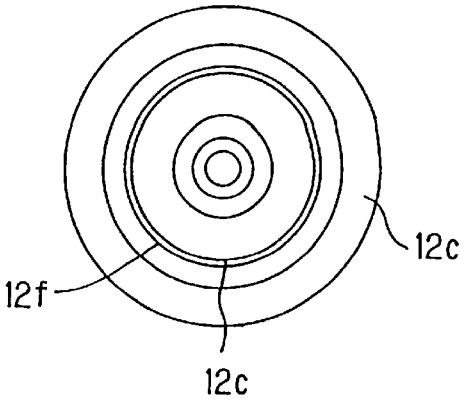
Figure 26:
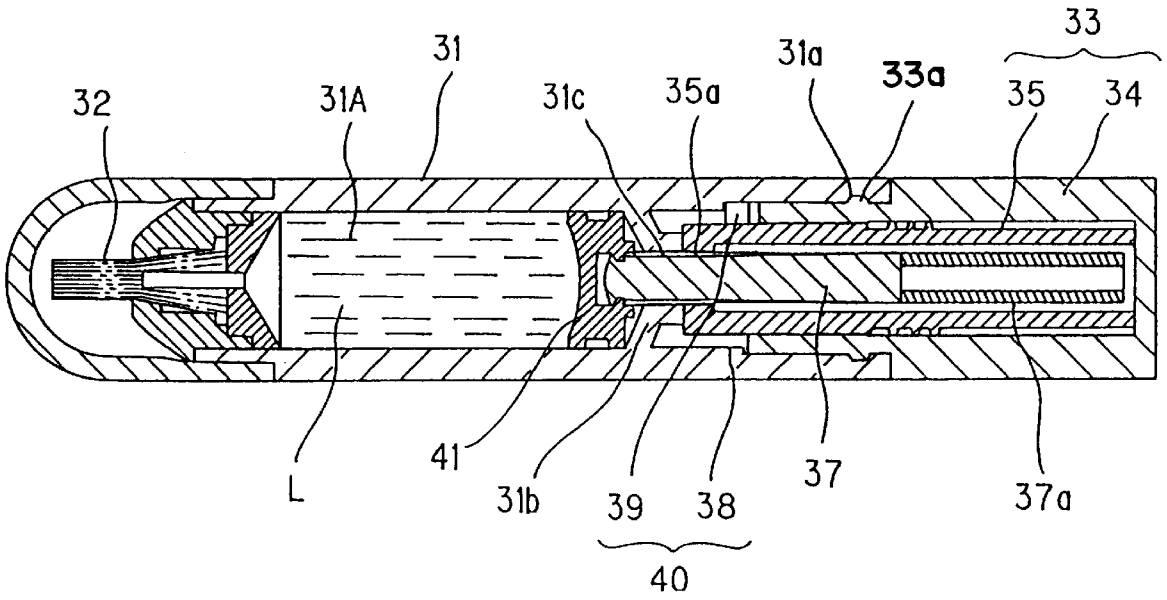
FIG. 26 PRIOR ART
FIG. 26 is a vertical sectional side view showing a conventional liquid applicator.
Figure 28:
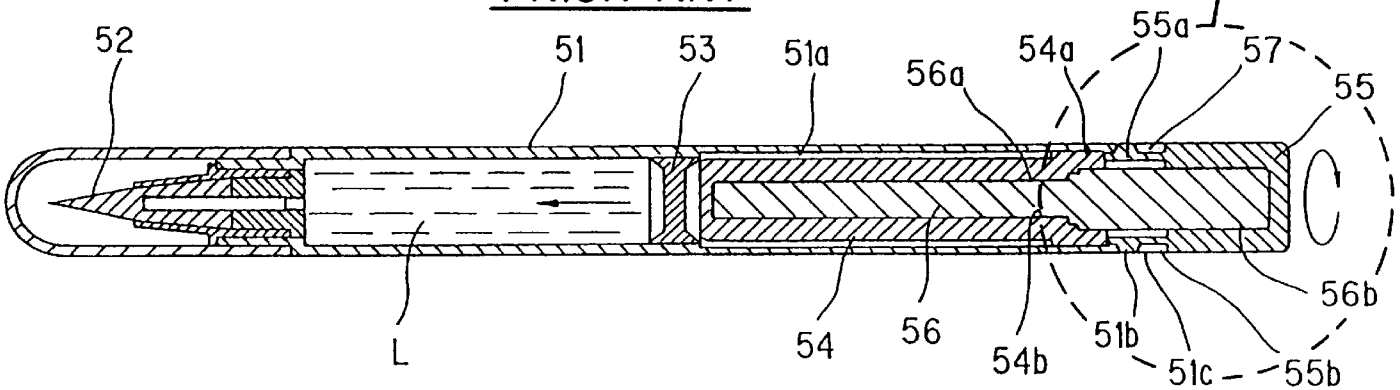
FIG. 28 PRIOR ART
FIG. 28 is a vertical sectional side view showing another example of a conventional liquid applicator.
Figure 28A:
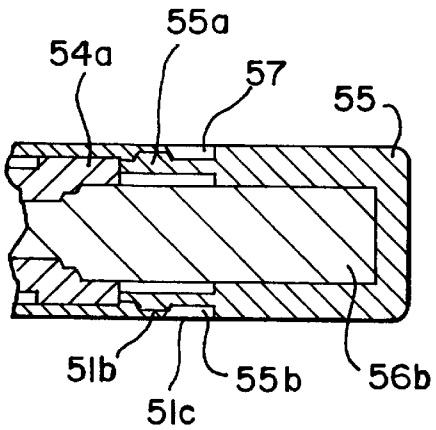
FIG. 28*a* is an exploded view of the right end of the prior art illustrated in FIG. 28.
Figure 27:
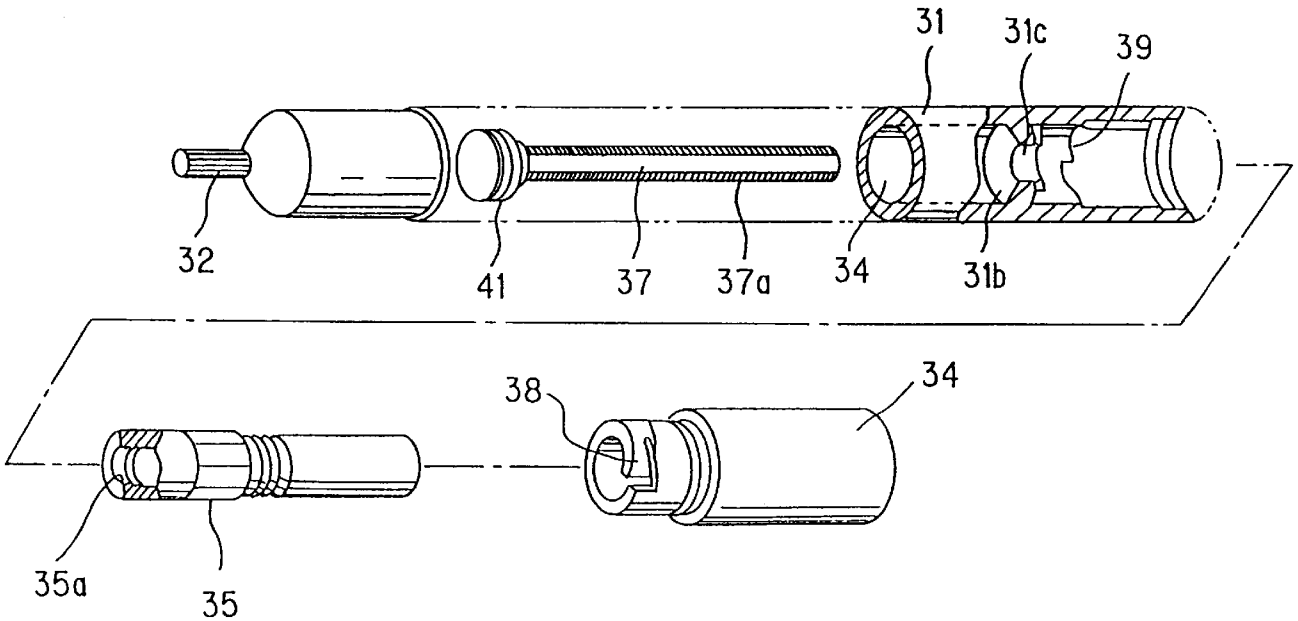
FIG. 27 PRIOR ART
FIG. 27 is an illustrative perspective view with a partial vertical section of that shown in FIG. 26.

Next, the second embodiment of the present invention will be described with reference to FIGS. 20 and 25.

Liquid applicator 1 in the first embodiment uses a brush element which is suitable for fine application such as lip coloring, eyebrow coloring etc. In contrast, a liquid applicator 20 in this embodiment is suitable for an application across a relatively wide range such as for hairdye for coloring hair.

Accordingly, liquid applicator 20 in this embodiment has a main body 22 having a greater diameter (see FIG. 20) than main body 2 in the first embodiment in order to reserve an ample amount of liquid paint L. Correspondingly to this, the components to be accommodated in main body 22 (liquid pressing mechanism 24) as well as fitted components (application element 23 and front barrel 26) etc., are increased in their outside dimensions. The components in liquid pressing mechanism 24 have almost the same configurations as in the first embodiment except in that the dimensions are different as stated above. So, in the drawings, the similar or corresponding components to those shown in the first embodiment are allotted with the same reference numerals.

In liquid applying mechanism 24 in the second embodiment, piston 14 is joined to the front end of screw rod 13 while male thread 13*a* of screw rod 13 is screw fitted to female thread 11*d* formed in the front part of fixed cylinder 11 which is fixed to main body 22 with fitting recesses 11*k* mated with fitting projections 22*e* formed on the inner surface of main body 22. Feed element 12 is inserted rotatably and detachably into fixed cylinder 11 (see FIGS. 22 and 23). Cam portion 12*f* formed in resilient piece 12*e* of feed element 12 (see FIGS. 24 and 25) is detachably engaged with cam groove 11*e* (see FIG. 23) formed on the inner surface of fixed cylinder 11. The aforementioned screw rod 13 is fitted through extraordinarily shaped fitting hole 12*h* formed at the front end part of feed element 12 so that the rod can move in the longitudinal direction and will not rotate. In this embodiment, projected portion 12*a* of feed element 12 also serves as a crown so that only projected portion 12*a* constitutes the rotary actuator.

In this way, liquid pressing mechanism 4 in the second embodiment has a substantially similar configuration to that in the first embodiment. Also the operation is almost the same as the first embodiment, that is, rotating feed element 12 causes screw rod 13 to move forwards whilst rotating and hence move piston 14 forwards so that stored liquid paint L is supplied to an application element 23.

Here, in the second embodiment, application element 23 mounted to the front end of main body 22 differs from that shown in the first embodiment.

Application element 23 shown here is configured of a brush-like member 24 in which multiple bundles of many bristles 24*a* are implanted on a disc-like holder 24*b*, a cylindrical comb-like member 25 in which multiple comb teeth 25*a* of small-diametric bars are planted upright so as to enclose brush-like member 24, and a cylindrical, projected pipe member 26 having a head and being fixed to the inner face in the rear portion of comb-like member 25. A pipe (flow channel) 26*a* is integrally projected from the head of projected pipe member 26. This pipe 26*a* is inserted through a passage hole 24*b*1 formed in the center of holder 24*b* and is projected on the side of brush-like member 24.

This application element 23 is press fitted and fixed to the inner surface of small-diametric portion 2*a* of main body 22. Liquid paint L is pushed forwards by piston 14 so as to flow forwards into brush-like member 24 by way of pipe 26*a* of projected pipe member 26 and supply brush-like member 24 located therearound.

Upon use of this liquid applicator 20, the liquid applicator is moved by combing the hair with comb teeth 25*a* with comb teeth 25*a* of comb-like member 25 and brush-like member 24 being abutted on the hair to be painted. This configuration allows comb teeth 25*a* of comb-like member 25 to proceed and comb the hair and the bristles of brush-like member 24 to reach the roots of the hair, so that the supplied liquid paint can permeate throughout the hair, thus making it possible to produce a beneficial applied state of the hair.

In the above embodiments, slits 11*f* are formed in fixed cylinder 11 to provide for flexibility so as to facilitate the fixed cylinder to be press fitted into main body 2 and feed element 12. However, depending upon the material, shape, wall thickness and other factors of fixed cylinder 11, it is possible to press fit it into main body 2 and feed element 12 without any slit. So slit 11*f* is not the essential element.

Liquid applicators 1 and 20 of the invention are not limited to those for lip coloring, eyebrow coloring or hairdye, but can be applied to other liquid paints. The shape and structure of the application element can be varied as appropriate depending upon its usage.

INDUSTRIAL APPLICABILITY

In accordance with the present invention described heretofore, in stead of directly fitting and engaging the rotary actuator in the liquid pressing mechanism for pressing the liquid paint stored in the main body toward the front barrel side, the rotary actuator is adapted to be fitted to the annular fitting portions of the fixed cylinder inserted in the main body. Therefore, it is possible to set up a desired fitting structure between the fixed cylinder and the rotary actuator depending upon the needed strength, regardless of the shape and configuration of the main body.

Further, the liquid pressing mechanism can be assembled markedly easily because the constituents such as the fixed cylinder, feed element, screw rod, piston and the like can all be inserted from the rear of the barrel body. Accordingly, for example, all the constituents may be assembled first outside the barrel body so that the thus unit-assembled liquid pressing mechanism may be inserted altogether from the rear of the barrel body. Thus, it is possible to enhance the efficiency of the assembly work. Further, the shape of the front part of the main body can be designed regardless of the configurations of the piston, etc., so that the design flexibility can be markedly improved.

What is claimed is:

1. A liquid applicator comprising:

a cylindrical main body having a predetermined application element at a front end thereof;

a liquid pressing mechanism mounted to the main body for pushing a liquid paint stored in the main body forwards to supply the application element with the liquid paint, wherein the liquid pressing mechanism comprises:

a fixed cylinder having a cylindrical shape which is press fitted into a rear opening of the main body and fixed to an inner face of the main body and has cam grooves on an inner surface thereof and a female thread at the front end thereof;

a feed element having a cylindrical shape to be press fitted to the fixed cylinder so as to be rotatable, having a rotary actuator projected rearwards from the main body and an inserted portion located in front of the rotary actuator and inserted into fixed cylinder, the inserted portion having an extraordinarily shaped fitting hole at the front end thereof and having a cam portion formed of a cantilever spring on the peripheral surface thereof which engages the cam grooves so as to allow the rotary actuator to only rotate in one direction;

a screw rod having a cross-section substantially identical to that of the fitting hole in the feed element and fitted through the fitting hole so as to move in the longitudinal direction and so as not to be rotatable, and having a male thread on the peripheral surface thereof which is screw fitted with the female thread of the fixed cylinder; and a piston fixed to the front end of the screw rod projected forward from the female thread of the fixed cylinder and slidably inserted whilst maintaining a fluid-tight state with respect to the inner surface of the fixed cylinder, characterized in that the screw rod is turned by rotating the rotary actuator so as to move the screw rod forward by means of the screw engagement of the screw rod with the female thread, whereby the piston jointed to the front end of the screw rod pushes out the liquid inside fixed cylinder to the application element.

2. The liquid applicator according to claim 1, wherein the feed element has slits which extends from the rear to the front.

3. The liquid applicator according to claim 1, wherein the application element is configured of a brush element formed by binding a large number of hairs at one end.

4. The liquid applicator according to claim 1, wherein the application element is configured of a brush member in which a large number of bristles are implanted in a holder, comb-teeth elements planted upright around the brush member, and a flow channel for establishing communication between the main body side and the bristle side with respect to the holder.

* * * * *